US007731310B2

(12) United States Patent
Kohlmann et al.

(10) Patent No.: US 7,731,310 B2
(45) Date of Patent: Jun. 8, 2010

(54) DIAGONALLY EXTENDING SLIDEOUT DRAWER ASSEMBLY AND STRUCTURE THEREWITH

(75) Inventors: Michael Kohlmann, Sheboygan, WI (US); Nicholas W. Paterson, Sheboygan Falls, WI (US); Michael Terrill, Cedarburg, WI (US); Matthew M. Smeltzer, Blue Grass, IA (US)

(73) Assignee: Kohler Co., Kohler, WI (US)

( * ) Notice: Subject to any disclaimer, the term of this patent is extended or adjusted under 35 U.S.C. 154(b) by 303 days.

(21) Appl. No.: 11/739,850

(22) Filed: Apr. 25, 2007

(65) Prior Publication Data

US 2008/0263761 A1 Oct. 30, 2008

(51) Int. Cl.
*A47K 1/04* (2006.01)

(52) U.S. Cl. ..... 312/228; 312/287; 312/330.1

(58) Field of Classification Search ..... 312/140.3, 312/209, 228, 229, 287, 330.1, 334.1, 334.7, 312/334.17, 334.27, 334.32
See application file for complete search history.

(56) References Cited

U.S. PATENT DOCUMENTS

| | | | | | |
|---|---|---|---|---|---|
| 799,253 | A | * | 9/1905 | Nichols | 312/226 |
| 1,071,599 | A | * | 8/1913 | Zachara | 312/235.5 |
| 1,104,917 | A | * | 7/1914 | Miller | 312/278 |
| 1,187,356 | A | | 6/1916 | Marbach | |
| 1,458,449 | A | | 6/1923 | Snyder | |
| 2,008,078 | A | * | 7/1935 | Martin | 108/26 |
| 2,627,863 | A | * | 2/1953 | Cavicchioli | 134/104.3 |
| 3,285,685 | A | * | 11/1966 | Hewett | 312/287 |
| 3,825,310 | A | * | 7/1974 | Roemer | 384/23 |
| 4,290,659 | A | | 9/1981 | Yoshiyuki | |
| 4,648,828 | A | * | 3/1987 | Abe et al. | 425/288 |
| 5,277,487 | A | * | 1/1994 | Simon | 312/278 |
| D371,701 | S | | 7/1996 | Jolly | |
| 5,615,936 | A | * | 4/1997 | Simmons et al. | 312/238 |
| 5,662,398 | A | * | 9/1997 | Swallow | 312/238 |
| 6,142,596 | A | * | 11/2000 | Carson | 312/334.39 |
| 6,193,338 | B1 | * | 2/2001 | Kocer | 312/194 |
| 6,394,567 | B1 | * | 5/2002 | Welch | 312/334.41 |
| 6,401,503 | B1 | * | 6/2002 | Lin | 70/209 |
| 6,837,557 | B2 | * | 1/2005 | Domenig | 312/334.34 |

(Continued)

FOREIGN PATENT DOCUMENTS

WO WO2004082431 9/2004

OTHER PUBLICATIONS

Azura. "Pablo Vanity Table". Item No. QB039. SimplyVanities.com online catalog. Copyright 2005-2006 A SimplyVanities.com company.

(Continued)

*Primary Examiner*—Janet M Wilkens
*Assistant Examiner*—Dan Rohrhoff
(74) *Attorney, Agent, or Firm*—Quarles & Brady LLP

(57) ABSTRACT

A bathroom fixture has slide-mounted pullout drawers that extend diagonally forward from its sides. The fixture can be a lavatory with a vanity base in which one or more drawers are slidably mounted. The slide mechanism for each drawer includes a fixed race and telescoping rail supporting the drawer from underneath and another fixed race and telescoping rail mounted between a side wall of the drawer and a vertical support member. Both telescoping slides are mounted diagonally with respect to the front and the associated side of the vanity.

14 Claims, 5 Drawing Sheets

U.S. PATENT DOCUMENTS

| | | | | |
|---|---|---|---|---|
| 6,976,716 | B2 * | 12/2005 | Lin | 292/288 |
| 7,273,212 | B1 * | 9/2007 | Kolbaba | 273/280 |
| 2005/0280340 | A1 | 12/2005 | Brustle et al. | |
| 2006/0043847 | A1 * | 3/2006 | Baron | 312/228 |
| 2006/0284526 | A1 * | 12/2006 | Pathmanathan et al. | 312/228.1 |

OTHER PUBLICATIONS

Amy Howard Collection. "Gardner End Table". AmyHowardCollection.com online catalog. Copyright 2003 AmyHowardCollection.com.

ISR for PCT/US2008/004475, Sep. 24, 2008/ 2 pages.

* cited by examiner

DIAGONALLY EXTENDING SLIDEOUT DRAWER ASSEMBLY AND STRUCTURE THEREWITH

CROSS-REFERENCE TO RELATED APPLICATIONS

Not applicable.

STATEMENT OF FEDERALLY SPONSORED RESEARCH OR DEVELOPMENT

Not applicable.

BACKGROUND OF THE INVENTION

The present invention relates to storage drawers, and more particularly, it relates to structures, such as vanities and other bathroom cabinets, which have side drawers that extend diagonally.

Conventional vanities for use in bathrooms, or other areas, typically may have a mirror on the wall or otherwise to the rear of the vanity, and may also include a sink when used in a bathroom. In many instances the vanity has a storage area below a top surface, and depending on the size of the vanity, may have drawers that slide directly forward, and/or doors which pivot outward from the front of the vanity.

It is not uncommon that the doors provide access to a storage area which may store cleaning supplies and other expendable items, which a user may need to access while using the vanity, sink, and/or mirror. It is not always convenient to have drawers in a vanity open forward, as this requires a person to move either backward or to the side, at which point they may be out of reach of the sink or out of view of the mirror.

Further, there may not be enough space in the room in which the vanity is installed for drawers and/or doors to open forward. Additionally, there may be market reasons such as product differentiation, or other aesthetic or design reasons, to have drawers and/or doors which open other than forward. Although it is relatively easy to conceive that a conventional drawer may be mounted in the vanity so as to open from the side, by rotating the drawer slides in the vanity orthogonal to their normal position, such drawers have the disadvantage of not opening toward a typical position of the user for easy access.

U.S. Pat. No. 1,071,599 shows a vanity structure in which a drawer opens by pivoting from the side. However, a disadvantage of this design is that the drawers are not well supported in the open position. U.S. Pat. No. 1,187,356 shows guides L and L' both at the sides and bottom of a cabinet structure, which will interact with corresponding elements of a drawer to allow the drawer to move orthogonally from the frame. U.S. Pat. No. 1,458,449 shows openable side drawers on opposed sides of a cabinet, which again pivot, and which are accordion style drawers which are not suitable to vanity designs. U.S. Pat. No. 4,290,659 shows multiple other pivoting structures associated with a cabinet, including a conventional drawer which can be accessed once a section is pivoted outward.

In any event, it is desired to develop further improved slideout drawers and structures, such as vanities, which have drawers that open from the side, and which still open forward with good support for the drawer.

SUMMARY OF THE INVENTION

In one embodiment the present invention provides a vanity which includes a frame having a platform, and an upright support within the frame and extending from the platform. The upright support is positioned diagonally within the frame. A lateral drawer slide is mounted on the lateral platform and diagonally to the frame. An upright drawer slide is mounted on the first upright support and diagonally to the frame, and a drawer is connected to both the lateral drawer slide and the upright drawer slide, where the drawer is extendable diagonally from the frame.

In another aspect the present invention provides a vanity which includes a frame having a front side, and opposing first side and second side connected to the front side. A platform is within the frame and extends from at least one of the front side, the first side and the second side. An upright support is within the frame and extends from the platform, where the support is positioned diagonally to the front side. A drawer slide is mounted on the platform and diagonally to the front side. Another drawer slide is mounted on the support and diagonally to the front side, and a drawer is connected to both drawer slides where the drawer is extendable diagonally from the first side.

In preferred forms, the first drawer is extendable diagonally forward from the first side. The first drawer can have a trapezoidal shape. The drawer includes a bottom connected to a diagonal wall, wherein one of the drawer slides is mounted to the bottom and the other is mounted to the diagonal wall.

In other preferred forms, a second upright support can be within the frame and extends from the platform, where the second upright support is positioned diagonally to the front side. A second set of drawer slides is included where one of which is mounted on the platform and diagonally to the front side and the other is mounted on the second upright support and diagonally to the front side. A second drawer is connected to both of the second set of drawer slides which extends diagonally forward from the second side. The second drawer can have a trapezoidal shape.

In other refinements the horizontal platform includes a top side, an opposed bottom side and a Y-shaped aperture extending through the top side and bottom side. This Y-shaped aperture is particularly advantageous when the vanity is part of a lavatory including a sink, as hot and cold water inlets for a faucet, and the sink drain can be routed through the vanity through the aperture, if desired.

The first side and the second side can be advantageously oriented approximately orthogonal to the front side. A sink can be connected to the frame.

In another embodiment the present invention includes a plumbing fixture which has a basin, and a frame connected to the basin. The frame has a front side, and opposing first side and second side connected to the front side. A platform is within the frame and extends from at least one of the front side, the first side and the second side. An upright support is within the frame and extends from the platform, where the support is positioned diagonally to the front side. A drawer slide is mounted on the platform and diagonally to the front side. Another drawer slide is mounted on the support and diagonally to the front side, and a drawer is connected to both drawer slides where the drawer is extendable diagonally from the first side.

Other aspects can be as previously described for the vanity. The basin can be a sink, a tub or a shower basin, and the plumbing fixture therefore can be a corresponding sink assembly, a bathtub assembly, or a shower assembly.

In another embodiment, the present invention provides a slideout drawer assembly which includes a drawer which has a bottom and upright sides connected to the bottom, wherein at least one side is at an oblique angle relative to another of the sides. A first slide mount is mounted to the oblique side, and a second slide is mounted to the drawer other than at the oblique side essentially parallel to the first slide. For example, the second side can be mounted to the drawer bottom at an angle corresponding to the oblique side. The slides cooperate to allow the drawer to move diagonally relative to a supporting structure to which the slides can be mounted.

An advantage of an embodiment of the present invention is that drawers which can open from the side while at the same time extend forwardly.

The present invention can advantageously provide a strong support for the diagonally opening drawers, while at the same time, reducing the chance of the drawers binding.

These and still other advantages of the present invention will become more apparent, and the invention will be better understood by reference to the following description of a preferred embodiment of the present invention taken in conjunction with the accompanying drawings.

BRIEF DESCRIPTION OF THE DRAWINGS

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE PREFERRED EMBODIMENT

Figure 1:
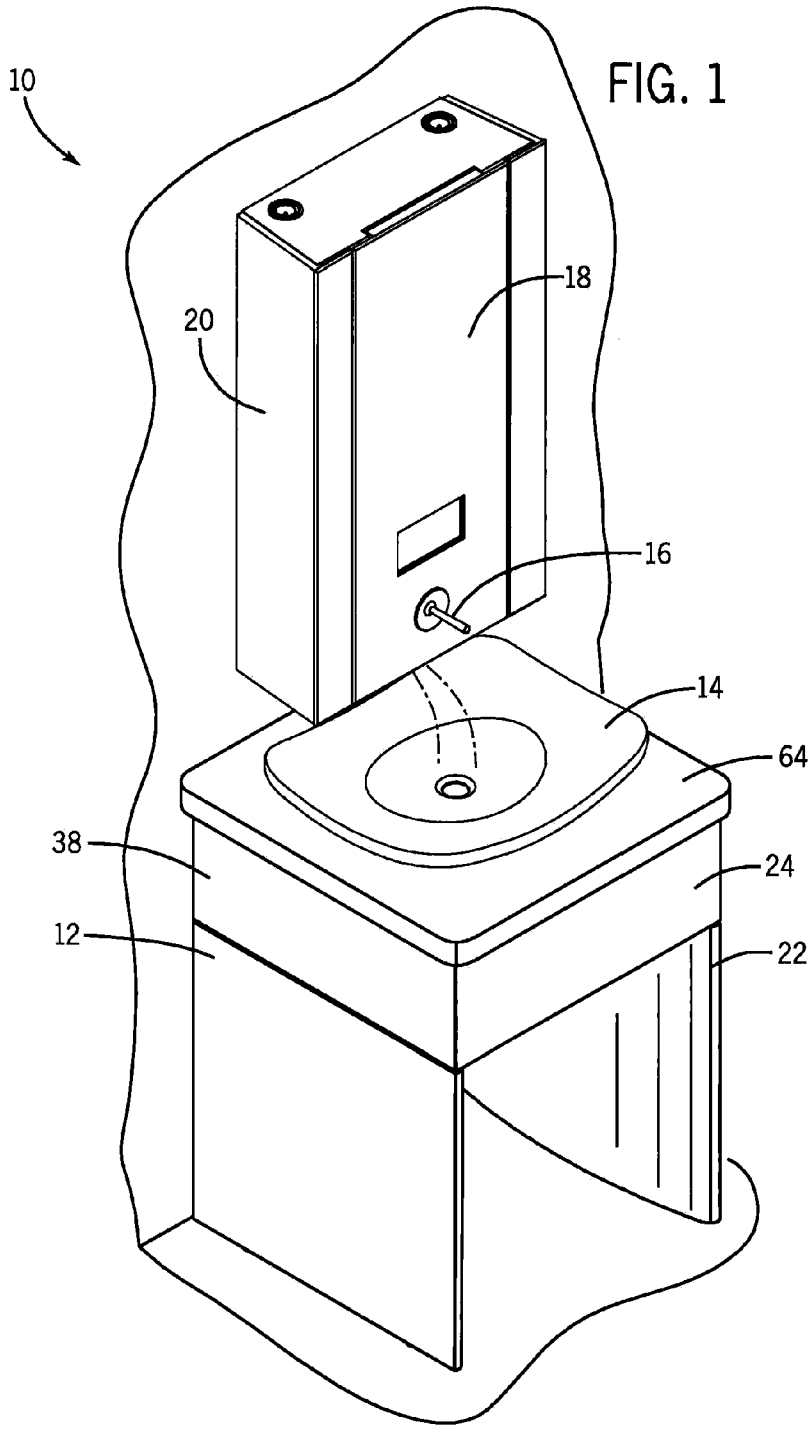
FIG. 1 is a perspective view of an embodiment of a plumbing fixture including a vanity according to the present invention, and where the fixture is shown in the form of a sink assembly.
Figure 2:
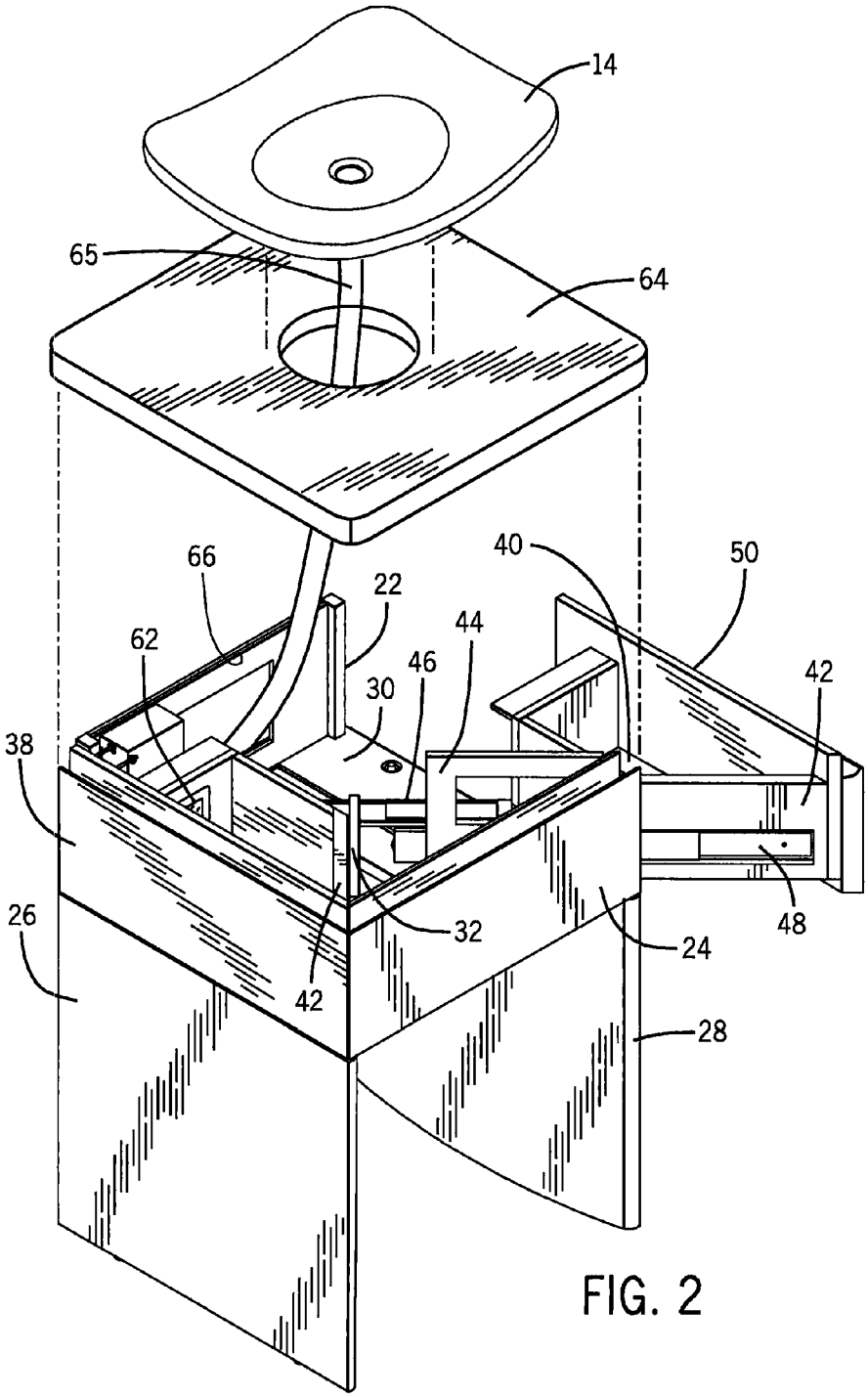
FIG. 2 is an exploded perspective view of the vanity and sink basin of FIG. 1, and illustrating a drawer extending diagonally from the side of the vanity.
Figure 3:
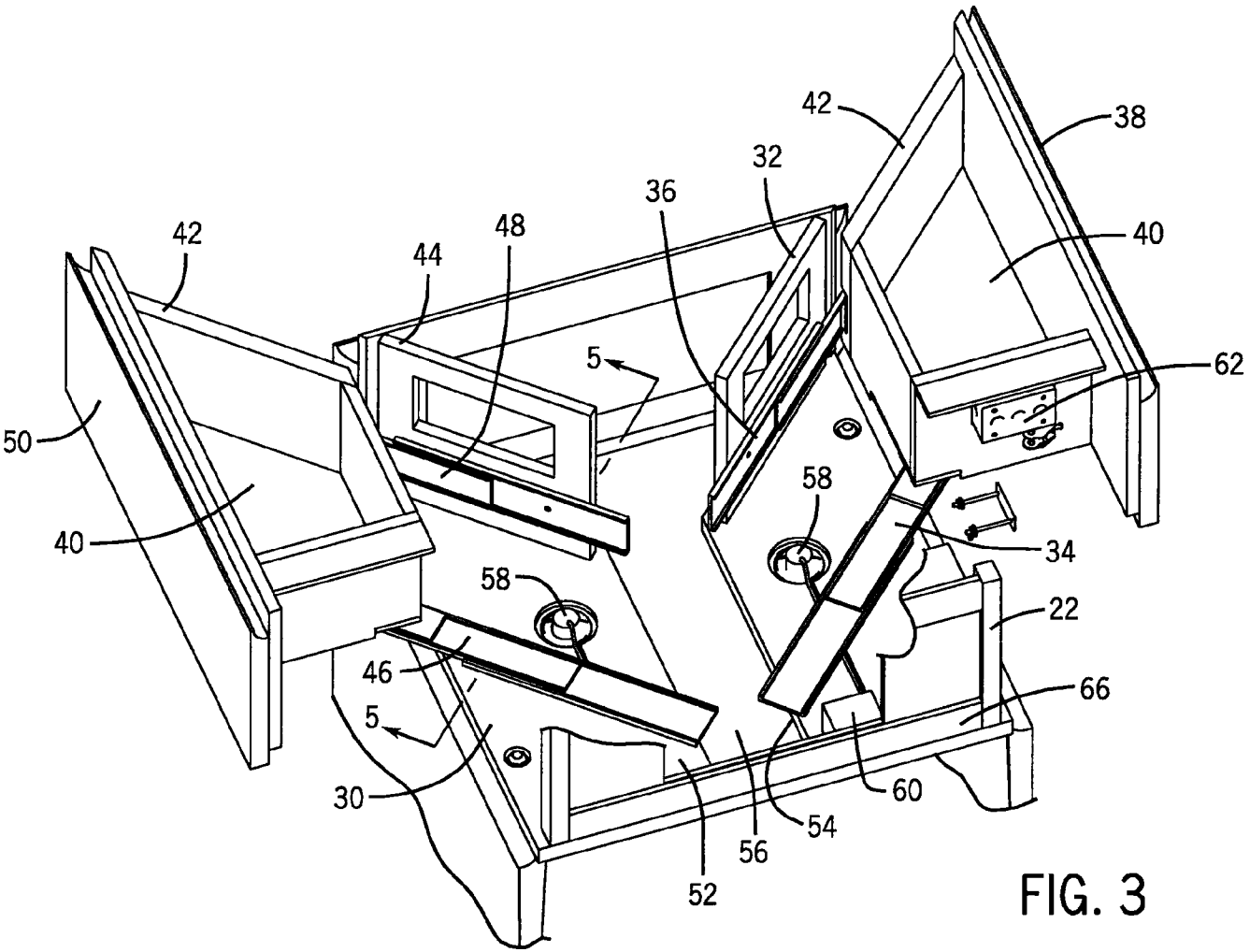
FIG. 3 is a fragmentary perspective view of the vanity of FIG. 1, with both drawers in an open position.
Figure 4:
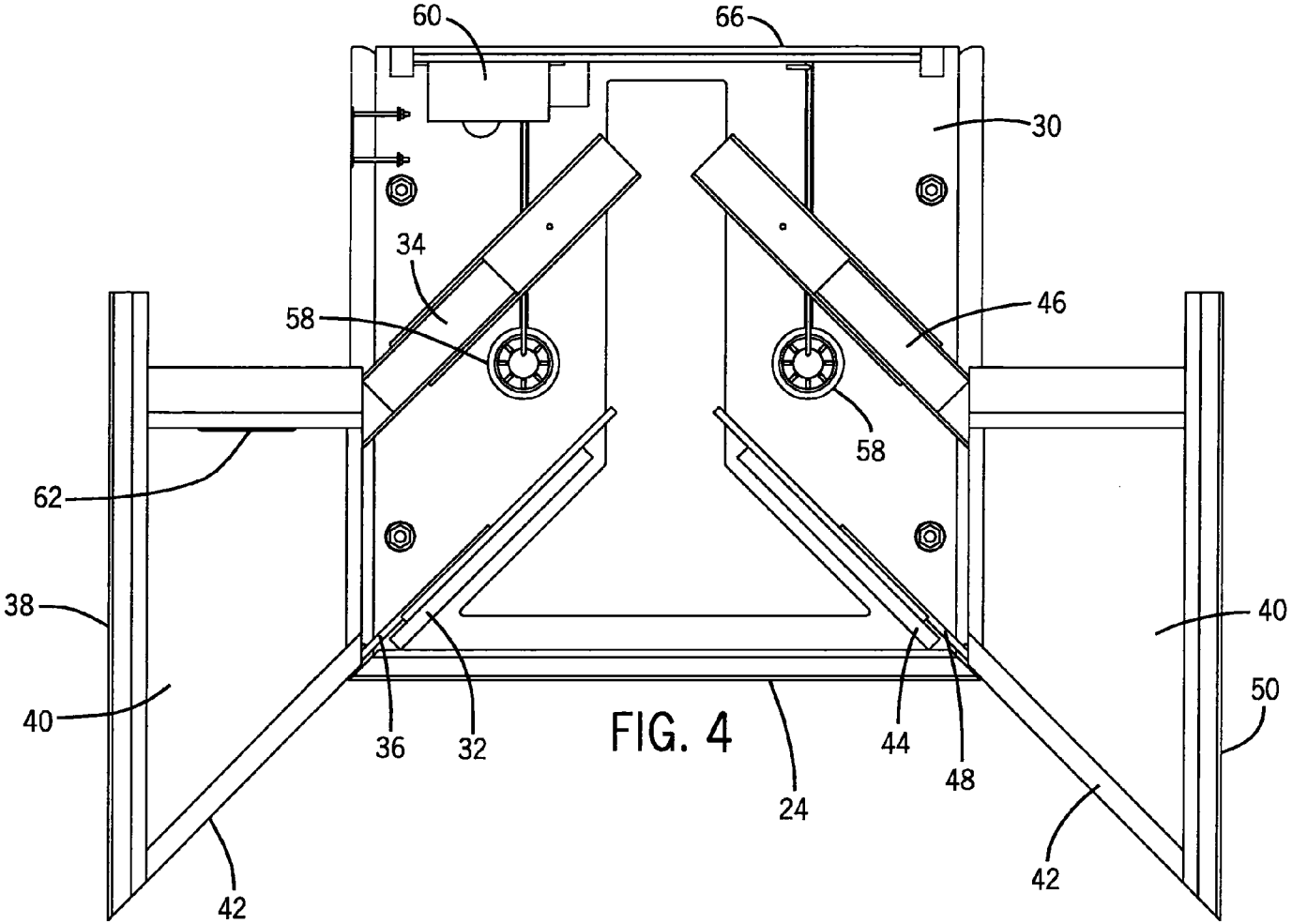
FIG. 4 is a top view of FIG. 3.

The present invention provides for mounting a slide-out drawer so that it can be pulled out diagonally with respect to its supporting structure. Two or more slides are mounted to walls of the supporting structure that are at angle to one another. One slide is mounted to a laterally extending surface and the other is mounted to an upright oblique surface. In the preferred embodiment described below, the lateral surface is described as "horizontal" and the upright surface is described as "vertical." It should be noted, however, that such terms should not be construed as limiting the invention, since it is within the scope of the invention for the slides to be mounted to any two (or more) suitable non-coplanar surfaces.

Referring now to the drawings, and more particularly to FIGS. 1-4, there is shown a plumbing fixture in the form of a sink assembly 10, which generally includes vanity 12 connected to a sink basin 14, and a faucet 16.

Faucet 16 includes a front 18, which can be part of cabinet 20 (e.g. a mirrored front surface of cabinet 20) or can otherwise be part of a faucet housing. An outlet spout (not shown, underneath cabinet 20) is connected to the faucet 16, and a mixing valve cartridge (not shown) is in fluid communication with the spout. Faucet 16 is described more fully in U.S. patent application Ser. No. 11/633,856, filed Dec. 5, 2006, and entitled "PLUMBING VALVE WITH STICK CONTROL HANDLE", incorporated by reference as if fully set forth herein. However, the embodiment of faucet 16 which is shown is only one of many potential faucet arrangements, and the present invention can have many other faucets, including conventional faucets connected to a sink top, and other faucets as are known.

A frame 22 is connected to basin 14, and frame 22 includes a front side 24, and opposing first side 26 and/or second side 28 connected to front side 24. A horizontal platform 30 is within frame 22, and extends from front side 24, first side 26 and/or second side 28. A first vertical support 32 is also within frame 22 and extends from horizontal platform 30. First vertical support 32 is positioned diagonally to front side 24. Terms such as front, bottom, etc. are as referenced to the typical orientations of an installed plumbing fixture 10, although the present invention can be oriented in a variety of ways and can have drawers which extend diagonally from any of the four (or more) sides.

A first horizontal drawer slide 34 is mounted on horizontal platform 30 and diagonally to front side 24. A first vertical drawer slide 36 is mounted on first vertical support 32 and diagonally to front side 24. Drawer slides 34, 36 can include a race and a slidable arm as shown, and can include other elements such as bearings and/or rollers, mounting hardware, and other elements as are known. Further, other types of drawers slides can be used.

A first drawer 38 is connected to both first horizontal drawer slide 34 and first vertical drawer slide 36. As shown, first drawer 38 is extendable diagonally forward from first side 26. First drawer 38 can have a trapezoidal shape as shown. In the embodiment shown, first horizontal drawer slide 34 is mounted to a bottom 40 of first drawer 38, and first vertical drawer slide 36 is mounted to a diagonal wall 42 of first drawer 38.

The present invention can include a second vertical support 44 within cabinet frame 22 and which extends from horizontal platform 30, which support 44 is positioned diagonally to front side 24. A second horizontal drawer slide 46 is mounted on horizontal platform 30 and diagonally to front side 24.

A second vertical drawer slide 50 can be mounted on second vertical support 44 and diagonally to front side 24. A second drawer 50 is connected to both second horizontal drawer slide 46 and second vertical drawer slide 48. In the embodiment shown, second drawer 50 is extendable diagonally forward from second side 28.

As with the first drawer, second drawer 50 has a trapezoidal shape in plan view. Horizontal platform 30 includes a top side 52, an opposed bottom side 54 and a Y-shaped aperture 56 extending through top side 52 and bottom side 54. First side 26 and second side 28 can be oriented approximately orthogonal to the front side.

The present invention can include other elements such as lights 58 such as LED accent, or other, lighting, a power supply 60 for the lights, and a power receptacle 62.

Figure 5:
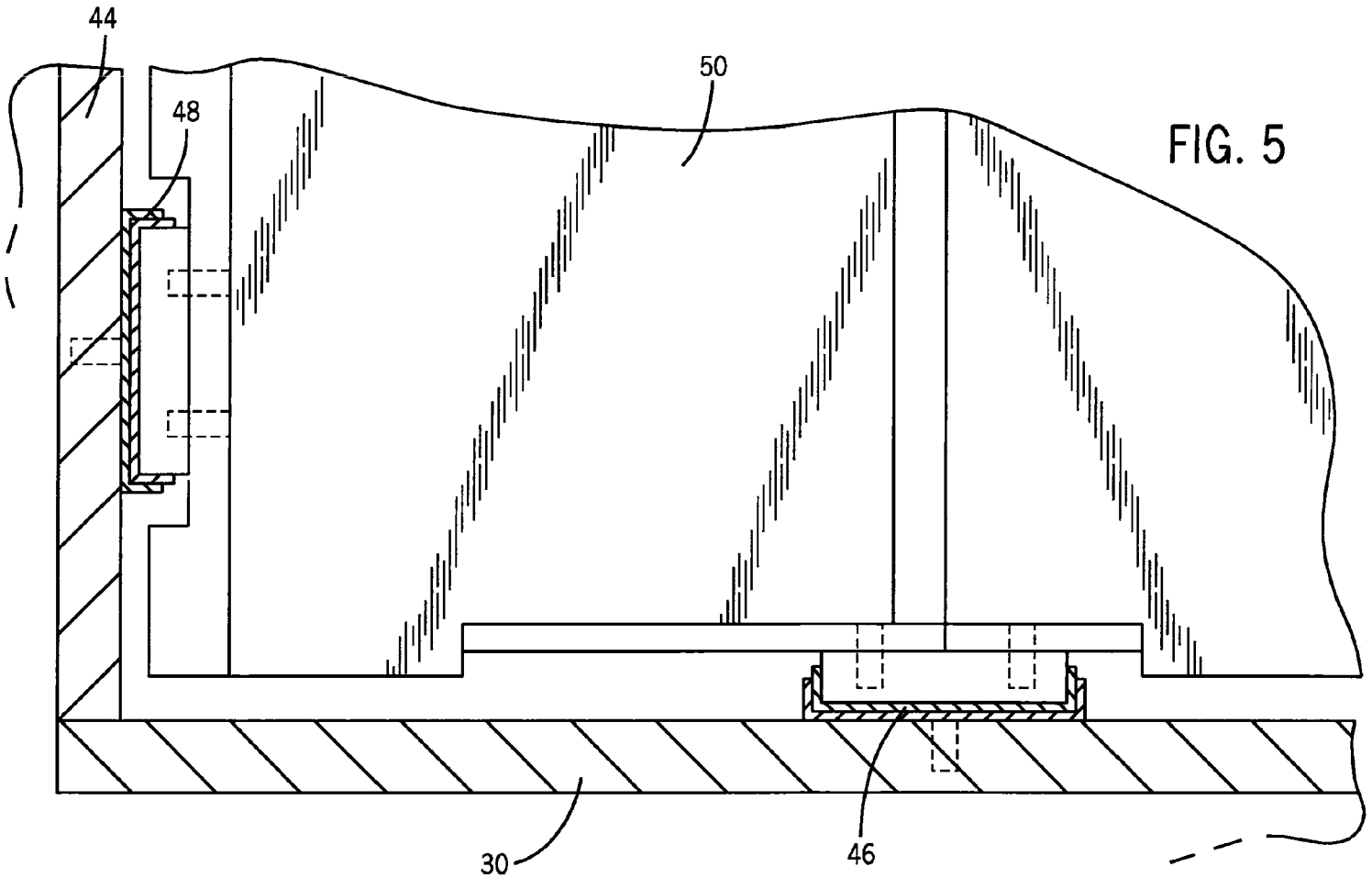
FIG. 5 is an enlarged partial cross-sectional view taken along section line 5-5 in FIG. 3.

FIG. 5 particularly illustrates the horizontal mounting of the horizontal drawer slides and the vertical mounting of the vertical drawer slides.

Although the embodiment shown includes a sink 14 which rests on a top surface 64 of vanity 12, with a drain 65 through top surface 64 and a rear panel 66, the present invention can easily be adapted to a more conventional sink which extends below the top surface, by positioning the drawers lower thereby allowing clearance for the bottom of the sink. Water inlets and drain can be routed through either the Y-shaped aperture 65 and/or rear panel 66.

Although the basin is shown as sink 14, alternatively, the basin can be a tub or a shower basin, and consequently plumbing fixture 10 can be a sink assembly, a bathtub assembly, or a shower assembly.

Other modifications and variations to the preferred embodiment will be apparent to those skilled in the art, which are intended to be within the spirit and scope of the invention. For example, the present invention can include a plurality of stacked drawers, or other multiple drawer configurations, on one or more sides including front and rear sides. Configurations which include drawers on the front or rear sides may be an instance when the plumbing fixture or vanity according to the present invention is in the form of a freestanding island, for example.

Therefore, the present invention is not to be limited to just the described most preferred embodiment. Hence, to ascertain the full scope of the invention, the claims which follow should be referenced.

INDUSTRIAL APPLICABILITY

The invention provides a drawer assembly for a vanity and/or a plumbing fixture, which can open diagonally from the side of the vanity or fixture, which allows the drawer to be on one of the sides, while at the same time extend forwardly.

What is claimed is:

1. A vanity, comprising:

a frame including a platform, an upright support within the frame and extending from the platform, the upright support positioned diagonally within the frame;

a lateral drawer slide mounted on the platform and diagonally to the frame;

an upright drawer slide mounted on the upright support and diagonally to the frame; and a drawer connected to both the lateral drawer slide and the upright drawer slide, the drawer being extendable diagonally from the frame, the drawer having a bottom attached to the lateral drawer slide and four upright sides in an essentially trapezoidal array connected to the bottom, wherein one lateral upright side is at an oblique angle relative to an exterior front side of said upright sides and is attached to the upright drawer slide, and wherein another lateral upright side is essentially orthogonal to the front side.

2. A vanity, comprising:

a frame including a front side, an opposing first side and second side connected to the front side;

a platform within the frame and extending from at least one of the front side, the first side and the second side;

an upright support within the frame and extending from the platform, the upright support positioned diagonally to the front side;

a drawer slide mounted on the platform and diagonally to the front side;

another drawer slide mounted on the upright support and diagonally to the front side; and a drawer connected to both drawer slides, the drawer being extendable diagonally from the first side, and the drawer having a bottom attached to the drawer slide mounted on the platform and having four upright sides in an essentially trapezoidal array connected to the bottom, wherein one lateral upright side is at an oblique angle relative to an exterior front side of said upright sides and is attached to the drawer slide mounted to the upright support and wherein another lateral upright side is essentially orthogonal to the front side.

3. The vanity of claim 2, wherein the drawer is extendable diagonally forward from the first side.

4. The vanity of claim 2, further including a second upright support within the frame and extending from the platform, the second upright support positioned diagonally to the front side;

a second set of drawer slides one of which is mounted on the platform and diagonally to the front side and the other being mounted on the second upright support and diagonally to the front side; and a second drawer connected to both of the second set of drawer slides for extending diagonally forward from the second side.

5. The vanity of claim 4, wherein the second drawer has trapezoidal shape.

6. The vanity of claim 2, wherein the platform includes a top side, an opposed bottom side and a Y-shaped aperture extending through the top side and bottom side.

7. The vanity of claim 2, further including a sink connected to the frame.

8. A plumbing fixture, comprising:

a basin;

a frame connected to the basin, the frame including a front side, and opposing first side and second side connected to the front side;

a platform within the frame and extending from at least one of the front side, the first side and the second side;

an upright support within the frame and extending from the platform, the upright support positioned diagonally to the front side;

a drawer slide mounted on the platform and diagonally to the front side;

another drawer slide mounted on the upright support and diagonally to the front side; and a drawer connected to both drawer slides, the drawer being extendable diagonally from the first side, and the drawer having a bottom attached to the drawer slide mounted on the platform and having four upright sides in an essentially trapezoidal array connected to the bottom, wherein one lateral upright side is at an oblique angle relative to an exterior front side of said upright sides and is attached to the drawer slide mounted to the upright support and wherein another lateral upright side is essentially orthogonal to the front side.

9. The plumbing fixture of claim 8, wherein the drawer is extendable diagonally forward from the first side.

10. The plumbing fixture of claim 8, wherein the drawer has a trapezoidal shape.

11. The plumbing fixture of claim 8, further including a second upright support within the frame and extending from the platform, the second upright support positioned diagonally to the front side;

a second set of drawer slides one of which is mounted on the platform and diagonally to the front side and the other being mounted on the second upright support and diagonally to the front side; and a second drawer connected to both of the second set of drawer slides for extending diagonally forward from the second side.

12. The plumbing fixture of claim 11, wherein the second drawer has trapezoidal shape.

13. The plumbing fixture of claim 8, wherein the platform includes a top side, an opposed bottom side and a Y-shaped aperture extending through the top side and bottom side.

14. The plumbing fixture of claim 8, wherein the basin is one of a sink, a tub and a shower basin, and the plumbing fixture is one of a sink assembly, a bathtub assembly, and a shower assembly.

* * * * *